US008391730B2

(12) United States Patent
Kitagawa

(10) Patent No.: US 8,391,730 B2
(45) Date of Patent: Mar. 5, 2013

(54) IMAGE FORMING APPARATUS

(75) Inventor: Oki Kitagawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 601 days.

(21) Appl. No.: 12/616,046

(22) Filed: Nov. 10, 2009

(65) Prior Publication Data

US 2010/0119244 A1 May 13, 2010

(30) Foreign Application Priority Data

Nov. 12, 2008 (JP) ..... 2008-289999

(51) Int. Cl.
*G03G 15/00* (2006.01)
*B65H 7/06* (2006.01)
*B65H 29/60* (2006.01)

(52) U.S. Cl. ..... 399/21; 399/18; 399/20; 271/902

(58) Field of Classification Search ..... 399/18–20
See application file for complete search history.

(56) References Cited

U.S. PATENT DOCUMENTS

| | | | | |
|---|---|---|---|---|
| 4,878,087 | A * | 10/1989 | Sakai et al. | 399/20 |
| 2002/0131802 | A1 * | 9/2002 | Shimizu et al. | 399/405 |
| 2005/0220505 | A1 * | 10/2005 | Hashimoto et al. | 399/322 |
| 2007/0059057 | A1 * | 3/2007 | Kinoshita et al. | 399/322 |
| 2008/0273884 | A1 * | 11/2008 | Yokobori et al. | 399/21 |

FOREIGN PATENT DOCUMENTS

| | | | |
|---|---|---|---|
| CN | 1677275 | A | 10/2005 |
| JP | 08-113426 | A | 5/1996 |
| JP | 2006-091330 | A | 4/2006 |

* cited by examiner

*Primary Examiner* — Daniel J Colilla
*Assistant Examiner* — Ruben Parco, Jr.
(74) *Attorney, Agent, or Firm* — Canon USA, Inc., IP Division

(57) ABSTRACT

When jam occurs in one of a tandem conveyance path and bypass conveyance path, a sheet is automatically discharged from the conveyance path where no jam has occurred. A sheet retained at the upstream side with respect to a first fixing device in a sheet conveying direction is automatically discharged to the outside of an image forming apparatus by using the conveyance path where no jam has occurred. After the automatic discharging of the sheet is completed, a user is prompted to remove the jammed sheet.

8 Claims, 8 Drawing Sheets

IMAGE FORMING APPARATUS

BACKGROUND OF THE INVENTION

1. Field of the Invention

The present invention relates to an image forming apparatus which uses electrophotography, and more particularly to an image forming apparatus such as a copying machine, a printer, or a facsimile device.

2. Description of the Related Art

An image forming apparatus discussed in Japanese Patent Application Laid-Open No. 2006-91330 includes two fixing devices installed in a conveying direction of a sheet. This image forming apparatus includes first and second conveyance paths respectively prepared as sheet conveyance paths to pass the sheet through the two fixing devices and to pass the sheet through only one of the fixing devices.

In the image forming apparatus, when jam (conveying abnormality) occurs, the burden of jam handling imposed on a user is reduced by automatically discharging a sheet (which is not in a jammed state) retained in the apparatus to the outside of the image forming apparatus. More specifically, when jam occurs in a paper feeding unit or the like other than the fixing device, a sheet retained in the first conveyance path is preferentially discharged, and then a sheet retained in the second conveyance path is discharged. Subsequently, the user carries out jam handling, in other words, removes jammed paper from the apparatus.

The aforementioned process is performed because the image forming apparatus employs a configuration in which the sheet is discharged to the outside of the image forming apparatus via a juncture position of the first and second conveyance paths. In other words, the process is performed in order to prevent jamming of the sheets respectively retained in the first and second conveyance paths at the juncture position.

However, in the image forming apparatus discussed in Japanese Patent Application Laid-Open No. 2006-91330, a solution is yet to be found to the occurrence of jam in one of the first and second conveyance paths, and hence there is room for improvement. In other words, when jam occurs in one of the first and second conveyance paths, the burden of jam handling imposed on the user needs to be reduced.

SUMMARY OF THE INVENTION

The present invention is directed to an image forming apparatus which can reduce the burden of jam handling imposed on a user when jam occurs in one of first and second paths.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
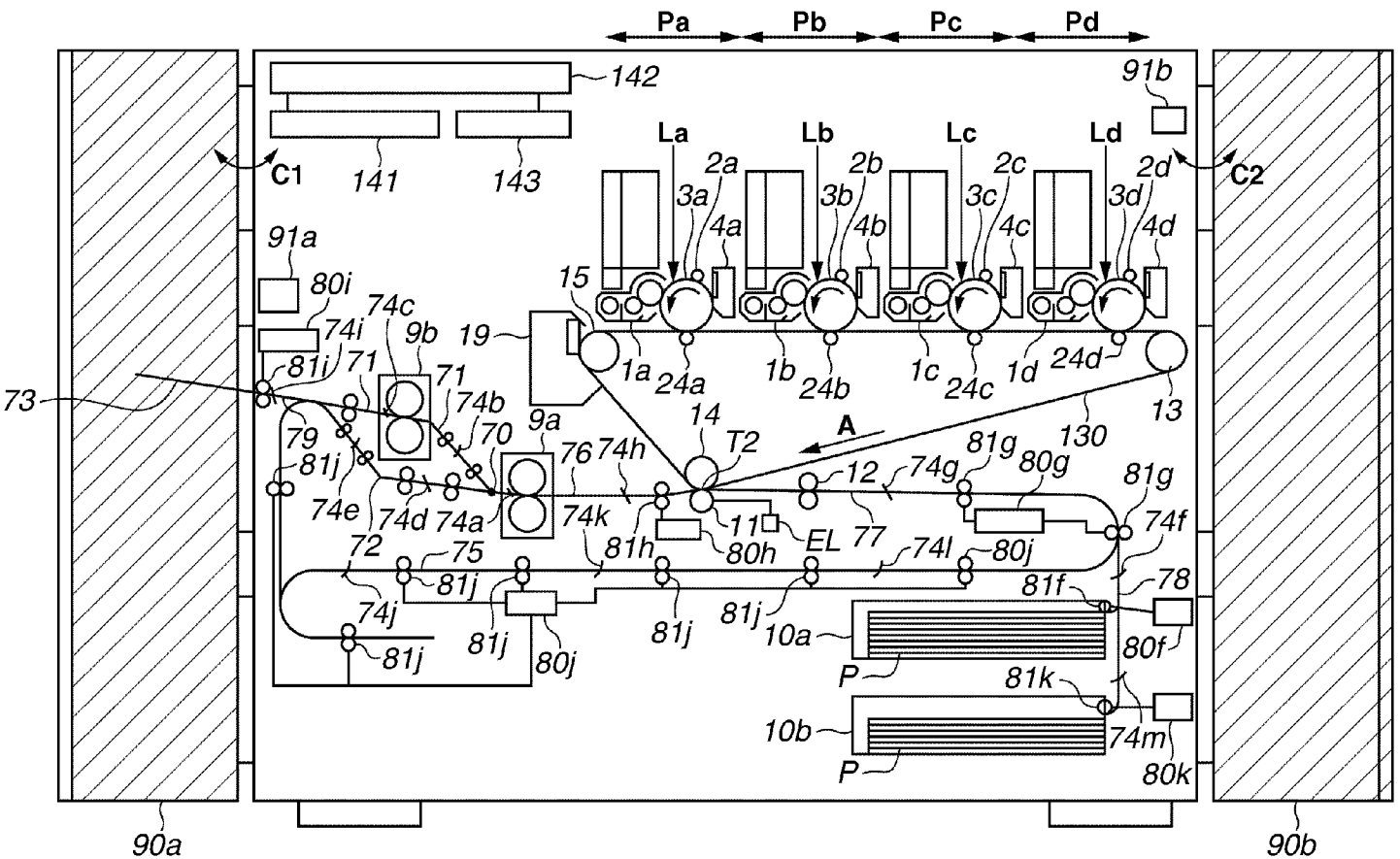
FIG. 1 is a sectional diagram illustrating an image forming apparatus according to a first exemplary embodiment of the present invention.

Referring to FIG. 1, an image forming apparatus 100 of a first exemplary embodiment of the present invention will be described. Hereinafter, members having a configuration and performing an operation similar to previously cited members are denoted by similar reference numerals to omit description as occasion demands.

The image forming apparatus illustrated in FIG. 1 includes first to fourth image forming units Pa to Pd disposed in parallel to function as image forming devices, and toner images of different colors are formed through latent-image forming, developing and transferring processes.

The image forming units Pa to Pd respectively include photosensitive drums 3*a* to 3*d* which function as image bearing members for exclusive use, and form toner images of respective colors to be charged to negative polarities on the photosensitive drums 3*a* to 3*d*. An intermediate transfer belt 130 is installed as an intermediate transfer member adjacent to the photosensitive drums 3*a* to 3*d*. The toner images of the respective colors formed on the photosensitive drums 3*a* to 3*d* are primary-transferred onto the intermediate transfer belt 130, and then transferred onto a sheet P by a secondary transfer unit T2. In the sheet P to which the toner images have been transferred, the toner images are fixed by heat and pressure applied from fixing units 9*a* and 9*b*, and then discharged as fixed images to the outside of the image forming apparatus 100. Drum chargers 2*a* to 2*d*, developing devices 1*a* to 1*d*, primary-transfer chargers 24*a* to 24*d*, and cleaners 4*a* to 4*d* are respectively disposed on outer peripheries of the photosensitive drums 3*a* to 3*d*. A light source device and a polygon mirror (not shown) are installed in an upper part of the image forming apparatus 100.

The rotating polygon mirror performs scanning with a laser beam emitted from the light source device. Then, a reflection mirror deflects a light flux of the laser beam, and an fθ lens converges the light flux on meridian lines of the photosensitive drums 3*a* to 3*d* to perform exposure, thereby forming latent images on the photosensitive drums 3*a* to 3*d* according to an image signal.

The developing devices 1*a* to 1*d* are filled with predetermined amounts of cyan, magenta, yellow, and black toners as developers by a feeding device (not shown). The developing devices 1*a* to 1*d* respectively develop the latent images on the photosensitive drums 3*a* to 3*d* to be visible as cyan, magenta, yellow, and black toner images.

The intermediate transfer belt 130 that functions as an image forming device is supported by a driving roller 13, a secondary transfer inner roller 4, and a tension roller 15. The tension roller 15 is biased by a spring member (not shown), and predetermined tension is applied to the intermediate transfer belt. The intermediate transfer belt 130 is rotated and driven in an arrow direction by the driving roller 13 at a peripheral velocity nearly equal to those of the photosensitive drums 3*a* to 3*c*. The image forming apparatus 100 of the exemplary embodiment has a process speed of 80 mm/seconds, and can form eighty images of A4 sizes a minute.

The yellow toner image of a first color on the photosensitive drum 3*a* is primary-transferred to an outer peripheral surface of the intermediate transfer belt 130 by an electric field and pressure generated by a primary transfer bias applied to the intermediate transfer belt 130 during passage through a nip between the photosensitive drum 3*a* and the intermediate transfer belt 130.

Similarly hereinafter, the magenta toner image of a second color, the cyan toner image of a third color, and the black toner image of a fourth color are sequentially superimposed to be transferred onto the intermediate transfer belt 130, thereby forming a synthetic color image corresponding to a target color image.

A secondary transfer roller 11 is disposed in a position facing the secondary transfer inner roller 14 borne in parallel to the intermediate transfer belt 130. The secondary transfer roller 11 is in contact with a bottom surface of the intermediate transfer belt 130. A secondary transfer voltage source Ec applies to the secondary transfer roller 11 a secondary transfer bias of a polarity opposite to a toner charged polarity. In the exemplary embodiment, a secondary transfer voltage is +2 kv.

After arrival of the synthetic color image at the secondary transfer unit T2 in which the intermediate transfer belt 130 and the secondary transfer roller 11 come into contact with each other, the synthetic color image is secondary-transferred to the sheet P as a sheet conveyed from a paper feed cassette 10*a* or 10*b* serving as a sheet containing device through a registration roller 12 and a transfer front guide constituting a sheet conveying mechanism. The image forming apparatus 100 of the exemplary embodiment is configured to continuously feed a plurality of sheets P from the paper feed cassette 10*a* or 10*b* to the secondary transfer unit T2.

An electrostatic force generated by application of the secondary transfer voltage to the secondary transfer roller 11 enables transfer of the synthetic color image from the intermediate transfer belt 130 to the sheet P.

The photosensitive drums 3*a* to 3*d* which has completed primary transfer are subjected to cleaning to remove transfer residual toners by the cleaners 4*a* to 4*d*, and then made ready for next latent image formation. The toners and other foreign objects left on the intermediate transfer belt 130 are removed by a cleaning blade 19 disposed to come into contact with a surface of the intermediate transfer belt 130.

Various image forming devices described above concerning formation of the toner images on the sheet constitute toner image forming devices.

The sheet P that have received the toner images is guided through a tandem conveyance path 71 sequentially to a first fixing device 9*a* functioning as a first image heating device and a second fixing device 9*b* functioning as a second image heating device. The toner images on the sheet P are fixed receiving heat and pressure, and then discharged as output articles via a paper discharge conveyance path 79 to a discharge portion 73 located outside the image forming apparatus 100.

The sheet P heated by the first and second fixing devices 9*a* and 9*b* can be conveyed, in place of being conveyed toward the discharge portion 73, to a two-sided conveyance path 75 to be conveyed again to the secondary transfer unit T2. In addition, in the exemplary embodiment, through a bypass conveyance path 72 as a second path, the sheet P heated by the first fixing device 9*a* (one of the heating devices) can be conveyed to the discharge portion 73 and the two-sided conveyance path 75 without passing through the second fixing device 9*b* (another heating device). Switching between the tandem conveyance path 71 and the bypass conveyance path 72 is performed by a flapper 69. The tandem conveyance path 71 and the bypass conveyance path 72 are combined together at a juncture position before reaching the discharge portion.

Figure 3:
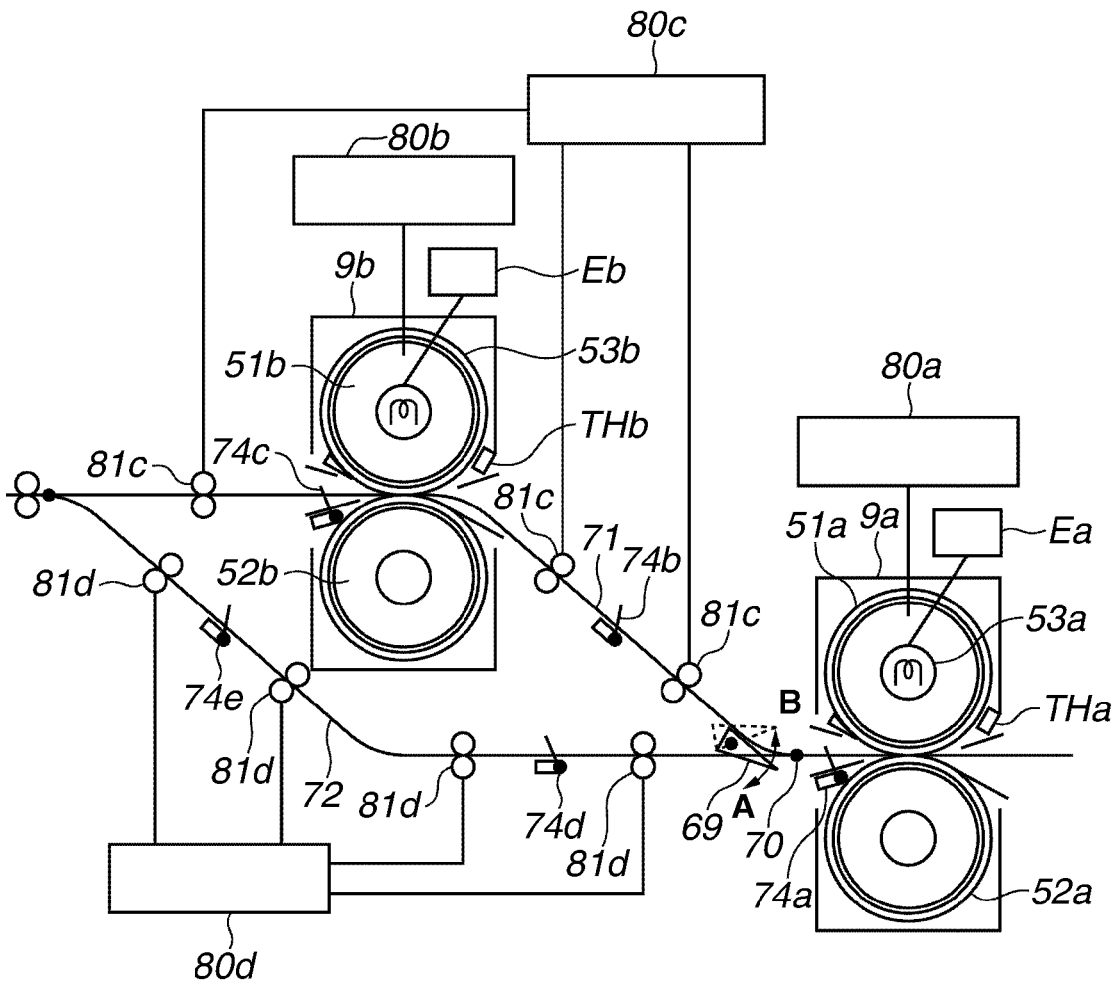
FIG. 3 is a sectional diagram illustrating fixing devices and conveyance paths included in the image forming apparatus of the first exemplary embodiment of the present invention.

Referring to FIGS. 1 and 3, a method for conveying the sheet in each conveyance path and each paper feed cassette will be described. The tandem conveyance path 71, the bypass conveyance path 72, the two-sided conveyance path 75, a before-fixing conveyance path 76, a before-registration conveyance path 77, and a paper discharge conveyance path 79 respectively include conveying rollers 81*c*, 81*d*, 81*j*, 81*h*, 81*g*, and 81*i* disposed to function as sheet conveying mechanisms. The paper feed cassettes 10*a* and 10*b* respectively include conveying rollers 81*f* and 81*k* disposed to function as sheet conveying mechanisms. The conveying rollers 81*c*, 81*d*, 81*j*, 81*h*, 81*g*, 81*i*, 81*f*, and 81*k* are rotated and driven by conveying motors 80*c*, 80*d*, 80*j*, 80*h*, 80*g*, 80*i*, 80*f*, and 80*k*. Each rotating conveying roller comes into contact with the sheet P, thereby conveying the sheet P in each conveyance path and each paper feed cassette.

FIG. 1 illustrates a state where front doors 90*a* and 90*b* covering a front of the image forming apparatus 100 are both opened by about 120°, while image formation is performed when the doors 90*a* and 90*b* are closed. The doors 90*a* and 90*b* respectively include door sensors 91*a* and 91*b* disposed to detect opened/closed states. When at least one of the doors 90*a* and 90*b* is open, the image formation is stopped. When jam occurs, by opening the doors 90*a* and 90*b*, the user can access the conveyance path of the sheet P, the first fixing device 9*a*, the second fixing device 9*b* or the like to carry out jam handling (removal of the jammed sheet from the apparatus).

The jam means abnormality in conveying the sheet, in other words, a situation or a phenomenon where conveyance of the sheet, i.e., an image forming job, needs to be interrupted due to inappropriate conveyance of the recoding material through the conveyance path. Thus, the occurrence of jam necessitates removal of all the sheets retained in the image forming apparatus. After removable of all the retained sheets from the image forming apparatus, the interrupted image forming job can be resumed.

Figure 2:
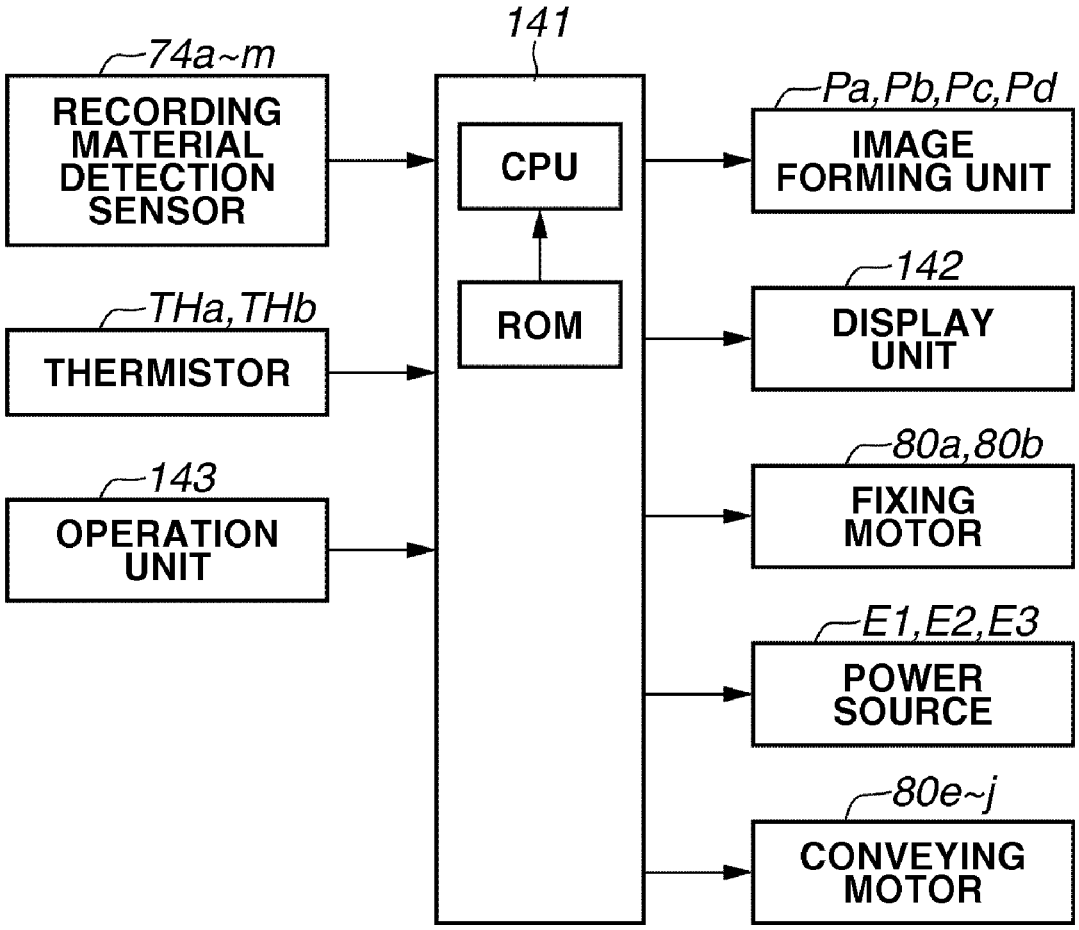
FIG. 2 is a block diagram illustrating the image forming apparatus of the first exemplary embodiment of the present invention.

As illustrated in FIG. 2, a controller 141 is disposed to control an operation of the image forming apparatus 100. The controller 141 that functions as a controller includes a CPU and a ROM for storing a control program, and controls operations of the image forming units Pa to Pd, the fixing motors 80*a* and 80*b*, the power sources Ea to Ec, and the conveying motors 80*c* to 80*j* based on information from sheet detection sensors 74*a* to 74*m*, thermistors THa and THb, and an operation unit 143. The sheet detection sensors 74*a* to 74*m*, the thermistors THa and THb, the operation unit 153, the fixing motors 80*a* and 80*b*, the power sources Ea and Eb, and the conveying motors 80*c* to 80*j* will be described below.

Next, referring to FIG. 3, the first and second fixing devices 9*a* and 9*b* employed by the embodiment will be described in detail.

The first and second fixing devices 9*a* and 9*b* are arrayed in series on the conveying path of the sheet P.

The first and second fixing devices 9*a* and 9*b* are similar in hardware configuration except for temperature control described below. Hence, subscripts to discriminate both from each other are omitted and configurations of the first and second fixing devices 9*a* and 9*b* will be described.

Each of the first and second fixing devices 9*a* and 9*b* includes a fixing roller 51 and a pressure roller 52 rotatably disposed to make a pair. The first and second fixing devices 9*a* and 9*b* are pressurized to form fixing nips, i.e., first and second nips, for passing the sheet P.

The fixing roller 51 of the present exemplary embodiment is configured in such a manner that a silicon rubber elastic layer having a thickness of 4 mm is placed on an Fe cylindrical core metal having an outer diameter of ϕ72 mm and an uppermost part is covered with a PFA tube having a thickness of 30 μm as a discrete layer.

The pressure roller 52 is configured in such a manner that a silicon rubber elastic layer having a thickness of 2.0 mm is placed on an Fe cylindrical core metal having an outer diameter of ϕ76 mm and an uppermost part is covered with a PFA tube having a thickness of 30 μm as a discrete layer. The pressure roller 52 is pressurized to the fixing roller 51 at total pressure of about 50 kgf, and driven and rotated by the pressure roller 52 driven by the fixing motor 80. In the fixing device of the exemplary embodiment, a fixing nip width is about 10 mm during pressurization.

A heater 53 such as a halogen heater is disposed in the fixing roller 51. Based on temperature information of the thermistor TH for detecting a temperature of the fixing roller 51, the controller 141 adjusts power supplied from the power source E to the heater 53 to maintain the fixing roller 51 at a predetermined temperature.

Though not disposed in the exemplary embodiment, a similar heater may be installed in the pressure roller 52.

In the exemplary embodiment, the fixing devices 9*a* and 9*b* are both roller-type fixing devices. However, one or both of fixing members facing each other may be belt-type fixing devices in which endless belts and pressure members form fixing nips. In the exemplary embodiment, the fixing devices 9*a* and 9*b* similar in configuration are used. However, fixing devices different from each other in configuration, for example, a roller-type fixing device and a belt-type fixing device, or a combination of roller-type fixing devices different in configuration, or a combination of belt-type fixing devices different in configuration, may be used.

Figure 7:
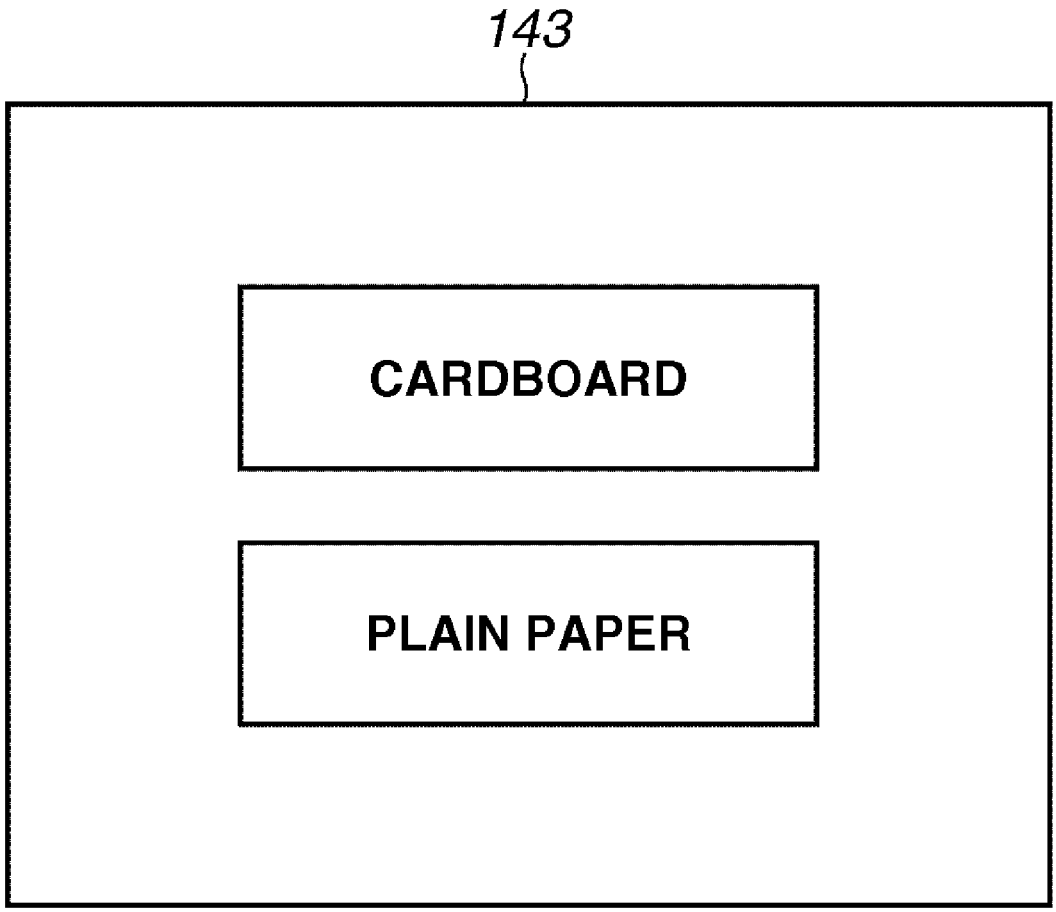
FIG. 7 illustrates operation units of the image forming apparatus of the first to third exemplary embodiments.

In the image forming apparatus 100, a cardboard mode for forming an image on a cardboard (150 g/m$^2$ or more) and a plain paper mode for forming an image on plain paper (less than 150 g/m$^2$) are executable. The user can select one of the cardboard mode and the plain paper mode by operating the operation unit 143 illustrated in FIG. 7.

When the cardboard mode is selected, a sheet P which is a cardboard is conveyed from the paper feed cassette 10*a* to the secondary transfer unit T2, and a synthetic color toner image is secondary-transferred from the intermediate transfer belt 130 to the sheet P. Subsequently, the sheet P is conveyed to the first fixing device 9*a* to heat the synthetic color toner image. The sheet P which has passed through the first fixing device 9*a* is guided to the tandem conveyance path 71 by the flapper 60 located in a position A indicated by a solid line in FIG. 3, and conveyed to the discharge portion 73 after the synthetic toner image is heated again by the second fixing device 9*b*. In order to form an image on the backside of the sheet P, the sheet P which has passed through the second fixing device 9*b* is conveyed to the two-sided conveyance path 75.

On the other hand, when the plain paper mode is selected, a synthetic color toner image is secondary-transferred by the secondary transfer unit T2 from the paper feed cassette 10*b* to a sheet P which is plain paper. Then, the sheet P is guided to the bypass conveyance path 72 by the flapper 60 located in a position B indicated by a broken line in FIG. 3, and conveyed to the discharge portion 73 bypassing the second fixing device 9*b*. In the plain paper mode, as in the case of the cardboard mode, in order to form an image on the backside of the sheet P, the sheet P is conveyed through the bypass conveyance path 72 to the two-sided conveyance path 75.

Referring to Table 1 below, temperature control of the fixing rollers 51*a* and 51*b* of the first and second fixing devices 9*a* and 9*b* in both of the aforementioned modes will be described.

TABLE 1

| | Fist fixing device 9a | Second fixing device 9b |
|---|---|---|
| Cardboard mode | 180° C. | 180° C. |
| Plain paper mode | 180° C. | 150° C. |

As illustrated in Table 1, when the cardboard mode is executed, power distribution to the heaters is controlled so that the fixing rollers 51*a* and 51*b* of the first and second fixing devices can both be set at 180°. On the other hand, when the plain paper mode is executed, the fixing roller 51*a* of the first fixing device 9*a* is controlled to be at 180°, while the fixing roller 51*b* of the second fixing device 9*b* which makes no contribution to fixing is controlled to be at a temperature lower than that in the cardboard mode. In the exemplary embodiment, in the plain paper mode, power distribution to the heater is controlled so that the fixing roller 51*b* of the second fixing device 9*b* can be set to 150°.

Thus, the two fixing devices 9*a* and 9*b* and the bypass conveyance path 72 are provided so that an amount of heat applied to the sheet P can be controlled. Accordingly, various sheets P can be dealt with.

Next, a method for detecting the sheet P in the fixing device and the conveyance path will be described.

In the exemplary embodiment, as illustrated in FIG. 3, each of the tandem conveyance path 71 and the bypass conveyance path 72 includes two sheet detection sensors as detecting devices. In the tandem conveyance path 71, one sheet detection sensor 74*b* is disposed in the conveyance path, and another sheet detection sensor 74*c* is disposed in a discharge port of the fixing device 9*b*. In the bypass conveyance path 72, two sheet detection sensors 74*d* and 74*e* are disposed.

The fixing devices 9*a* and 9*b* respectively include sheet detection sensors 74*a* and 74*b* in discharge ports. The sheet detection sensor 74*a* is provided in the discharge port of the fixing device 9*a*, the sheet detection sensor 74*b* is provided in the discharge port of the fixing device 9*b*, and sheet detection sensors 74*f* and 74*m* are provided in a paper feeding unit 78. A sheet detection sensor 74*g* is provided in the before-registration conveyance path 77, a sheet detection sensor 74*h* is provided in the before-fixing conveyance path 76, and sheet detection sensors 74*j*, 74*k* and 74*l* are provided in the two-sided conveyance path 75.

The exemplary embodiment uses a sheet detection sensor which converts presence of a sheet P into an electric signal to detect the material. In this sensor, a flag is pressed by deadweight of the conveyed sheet P and an optical axis of a transmissive photointerrupter sensor is blocked to shield light. The main body controller 141 manages sheet presence information from all the sheet detection sensors of the image forming apparatus 100 to determine the occurrence of jam. More specifically, if there is deviation from an ON-OFF chart calculated from a set size and a conveying speed in the conveying direction of the sheet P for a fixed period of time or more, the occurrence of jam is determined. In other words, delay jam is determined when a leading edge of sheet does not turn ON the sheet detection sensor at an ON-timing. Similarly, retention jam is determined when a trailing edge of sheet does not turn OFF the sheet detection sensor at an OFF-timing. For example, when winding jam occurs at the discharge port of the second fixing device 9*b*, the sheet detection sensor 74*c* is not turned ON at a predetermined timing, and hence the main body controller 141 determines delay jam.

Upon detecting jam in the tandem conveyance path 71 or the bypass conveyance path 72, the main body controller 141 immediately controls the conveying motor 80*c* or 80*d* to stop the conveying operation of the sheet on the conveyance path where the jam has occurred. Subsequently, the main body controller 141 switches the flapper 69 to automatically discharge the sheet on a side upstream of a branching position 70 of the tandem conveyance path 71 and the bypass conveyance path 72 in the conveying direction of the sheet, and then stops the operation of the image forming apparatus 100. The main body controller 141 displays (informs) the occurrence of jam, its occurrence position, and its processing method on a display unit 142 functioning as an informing device to prompt the user to carry out jam handling. Referring to a flowchart below, a procedure of the automatic discharge operation will be described in detail.

Referring to a flowchart of FIG. 4, the automatic discharge operation at the time of the occurrence of jam which is a gist of the present invention will be described. Operations of all the devices in the apparatus in the flowchart are controlled, determined or executed by the main body controller 141.

First, in step S1, at the time of completion of temperature control of the fixing devices 9*a* and 9*b* or an image forming preparation operation such as toner stirring operations in the developing devices 1*a* to 1*d*, a standby state is set to wait for image formation. In step S2, when an operation such as pressing of a copy button is performed to start an image forming operation, the main body controller 141 starts the image forming operations of the aforementioned image forming units Pa to Pd. The main body controller 141 adjusts, according to a mode selected by the user, outputs of the power sources Ea and Eb so that the fixing rollers 51*a* and 51*b* of the fixing devices 9*a* and 9*b* can be set to the temperatures illustrated in Table 1. Further, the main body controller 141 controls rotations of the conveying rollers 81*c* and 81*d* of the tandem and bypass conveyance paths 71 and 72 according to the selected mode.

In other words, when the "cardboard mode" is selected, the conveying roller 81*c* of the tandem conveyance path 71 is rotated, while rotation of the conveying roller 81*d* of the bypass conveyance path 72 is stopped. On the other hand, when the "plain paper mode" is selected, rotation of the conveying roller 81*c* of the tandem conveyance path 71 is stopped, while the conveying roller 81*d* of the bypass conveyance path 72 is rotated. Even if the "plain paper mode" is selected, the fixing roller 51*b* of the second fixing device 9*b* is rotated to maintain a predetermined temperature.

Conveyance of the sheet P from the paper feed cassette 10*a* or 10*b* is started in synchronization with timing of conveying the synthetic color toner image from the intermediate transfer belt 130 to the secondary-transfer unit T2.

In step S3, from this point of time, the main body controller 141 obtains detection information from all the sheet detection sensors in the image forming apparatus 100 to monitor an occurrence of jam of the sheet P. When the image forming operation is finished without any jam, and all sheets P having images formed thereon are discharged to the discharge portion 73, in step S13, processing in the flowchart is completed.

If jam occurs, in step S4, the main body controller 141 determines whether there is any sheet P in the branching position 70 where the path branches into the tandem conveyance path 71 and the bypass conveyance path 72 (refer to FIG. 3). More specifically, the main body controller 141 makes the determination based on history of a detection signal from the sheet detection sensor 74*a* set in the discharge port of the fixing device 9*a*. In the exemplary embodiment, a distance of a sheet conveyance path from the sheet detection sensor 74*a* to the branching position 70 is 38 mm, and a conveying speed is 380 mm/second, and hence it takes 0.1 second for the sheet P to pass therebetween. Thus, the main body controller 141 determines that there is a sheet P in the branching position 70 if 0.1 second or more has passed after switching of the detection signal from the recording detection sensor 74*a* to an "ON signal" or if 0.1 second is yet to pass after switching to an "OFF signal". If the main body controller 141 determines that there is a sheet Pin the branching position 70, an automatic discharge operation of a residual sheet P is inhibited, and hence the process proceeds to step S10.

On the other hand, if there is no sheet P in the branching position 70, in step S5, the main body controller 141 checks a jam-occurrence position of the sheet P. If the jam-occurrence position is in any one of the sheet detection sensors 74*b* and 74*c* of the tandem conveyance path 71 or the sheet detection sensors 74*d* and 74*e* of the bypass conveyance path 72, the process proceeds to step S6 to automatically discharge the sheet retained in the apparatus.

On the other hand, if jam occurs in a position other than the aforementioned position, i.e., one of the paper feeding unit 78, the before-registration conveyance path 77, the before-fixing conveyance path 76, the fixing device 9*a*, the paper discharge conveyance path 79, and the two-sided conveyance path 75, a sheet P left on a side upstream of the jam-occurrence position cannot be automatically discharged, and hence no automatic discharging is carried out. In other words, when jam occurs in any one of the sheet detection sensors 74*f*, 74*g*, 74*h*, 74*a*, 74*i*, 74*j*, 74*k*, 74*l*, and 74*m*, no automatic discharge operation is performed. Thus, in this case, the process advances to step S10. The main body controller 141 immediately controls rotations of all the conveying motors in the image forming apparatus 100 to stop rotations of the conveying rollers and displays the jam-occurrence position and its processing method on the display unit 142 functioning as the informing device to stand by. In other words, the main body controller 141 interrupts the image forming job to inform the user about jam handling. The jam handling may also be informed to a host computer connected to the image forming apparatus via a network. In other words, the controller 141 functioning also as the informing device may be configured to perform overall control so that information contents can be displayed on a monitor connected to the host computer.

If the jam-occurrence position is in one of the tandem and bypass conveyance paths 71 and 72, in step S6, in order to perform automatic discharging, the main body controller 141 controls the conveying motor to stop rotation of the conveying roller in the conveyance path where the jam has occurred, and then switches the flapper 69.

For example, when the sheet P conveyed to the fixing device 9*b* is wound on the fixing roller during execution of the cardboard mode and the jam occurs, delay jam of the sheet detection sensor 74*c* is determined. In this case, a jam-occurrence position is within the tandem conveyance path 71. Then, the main body controller 141 issues a stop signal to the conveying motor 80*c* and the fixing motor 80*b* to stop rotation of the conveying roller 81*c* in the tandem conveyance path 71. The main body controller 141 switches the flapper 69 to feed the sheet P to the bypass conveyance path 72, and rotates the conveying roller 81*d* in the bypass conveyance path 72.

As a result, the sheet left in the bypass conveyance path 72 is discharged to the discharge portion 73 outside the image forming apparatus.

Similarly, when jam occurs in the bypass conveyance path 72 during execution of the plain paper mode, the main body controller 141 issues a stop signal to the conveying motor 80*d* to stop rotation of the conveying roller 81*d* in the bypass conveyance path 72. Then, the main body controller 141 switches the flapper 69 to feed the sheet P to the tandem conveyance path 72, and rotates the conveying roller 81*c* in the tandem conveyance path 71.

As a result, the sheet left in the tandem conveyance path 71 is discharged to the discharge portion 73 outside the image forming apparatus.

If a sheet P is determined to be present on a conveyance path upstream of the branching position 70 in step S7, in step S8, the main body controller 141 controls the conveying motor to feed the residual sheet P to the discharge portion 73 via the bypass conveyance path 72, thereby performing an automatic discharge operation. When the sheet P is present on the conveyance path upstream of the branching position at the time of the occurrence of jam, the main body controller 141 obtains ON signals from the sheet detection sensors 74*a*, 74*f*, 74*g*, 74*h*, 74*j*, 74*k*, 74*l*, and 74*m* installed in the fixing device 9*a*, the before-fixing device conveyance path 76, the before-registration conveyance path 77, the paper feeding unit 78, and the two-sided conveyance path 75.

In this case, when sheets P are left in all the sheet detection sensors 74*a*, 74*f*, 74*g*, 74*h*, 74*j*, 74*k*, 74*m*, and 74*n*, the main body controller 141 only needs to control the conveying and fixing motors so that all the conveying and fixing rollers in the apparatus can rotate. However, if sheets P are left only in the sheet detection sensors 74*a* and 74*h* of the fixing device 9*a* and the before-fixing conveyance path 76, the main body controller 141 is not required to operate all the conveying and fixing motors. In this case, the main body controller 141 selectively operates only the fixing motor 80*a* for rotating the fixing roller 51*a* of the fixing device 9*a*, the conveying motor 80*h* for rotating the conveying roller 81*h* of the before-fixing conveyance path 76, and the conveying motors 80*d* and 80*i* necessary for conveying the residual sheet P to the discharge portion 73. Thus, the main body controller 141 performs control to operate only the conveying and fixing rollers necessary for conveying the residual sheet of the most upstream side when jam occurs, thereby executing an automatic discharge operation.

The main body controller 141 performs control so as to prevent overlapping of a sheet left in the tandem conveyance path 71 or the bypass conveyance path 72 used for automatic discharging, with a sheet left on the sheet conveying-direction on a side upstream of the fixing device 9*a* (first nip, branching position) in the conveyance path used for automatic discharging. In other words, the main body controller 141 controls each conveying mechanism so that the sheet left in the conveyance path used for automatic discharging can be discharged prior to the sheet left on the upstream side of the fixing device 9*a* in a sheet conveying direction.

At the time of the occurrence of jam, the intermediate transfer belt 130 bears a synthetic toner image. In order to prevent sticking of a toner on the sheet P, which is conveyed through the secondary transfer unit T2 to the discharge portion 73 after the occurrence of jam, the main body controller 141 switches a voltage applied to the secondary transfer roller 11 when the jam occurs, to a voltage of a same polarity as that of the toner.

In the exemplary embodiment, a voltage of −1 KV is applied to the secondary transfer roller 11 during the automatic discharge operation.

An unfixed toner image on the sheet P left in the before-fixing conveyance path 76 is fixed (heated) by the fixing device 9*a*, and hence the inside of the apparatus or user's hands are not stained even if the automatic discharge operation is carried out. So far, the jam in the tandem conveyance path 71 has been cited as an example. However, even if jam occurs in the bypass conveyance path 72, automatic discharging can similarly be carried out by switching the flapper 69 to the tandem conveyance path 71 side.

In step S10, after completion of all the automatic discharge operations, the apparatus stops its operation, and displays the occurrence of jam and its handling method on the display unit 142 to inform the user about jam handling, and stands by. More specifically, for example, when jam occurs in the fixing device 9*b*, the main body controller 141 performs control to display "open the front door to draw the fixing device 9*b*, and remove jammed paper" on the display unit 142, thereby prompting the user to remove the jammed paper.

The front doors 90*a* and 90*b* of the apparatus are always required to be opened so that the user can carry out work of drawing the fixing device 9*b*. Thus, in step S11, the main body controller 141 investigates presence of jammed paper at the time of checking whether the front doors 90*a* and 90*b* have been opened and then closed again, based on detection information from the door sensors 91*a* and 91*b* illustrated in FIG. 1.

In this case, if a detection result which the main body controller 141 obtains from the sheet detection sensor 74*b* of the fixing device 9*b*, changes to an "OFF signal", its means that the jammed paper has been removed, and hence the main body controller 141 determines that the jam handling has been completed and resets a jam error state. Then, in step S12, after an apparatus recovery operation such as a fixing device temperature readjustment is performed, the main body controller 141 resumes the interrupted image formation. The main body controller 141 returns to step S3 at the time of restarting the conveyance of the sheet P to continue monitoring of an occurrence of jam again.

According to the aforementioned flowchart, the automatic discharge operation is executed at the time of the occurrence of jam, and the number of sheets to be removed from the apparatus by the user (operator) can be reduced to a minimum. As a result, usability can be improved.

Figure 5:
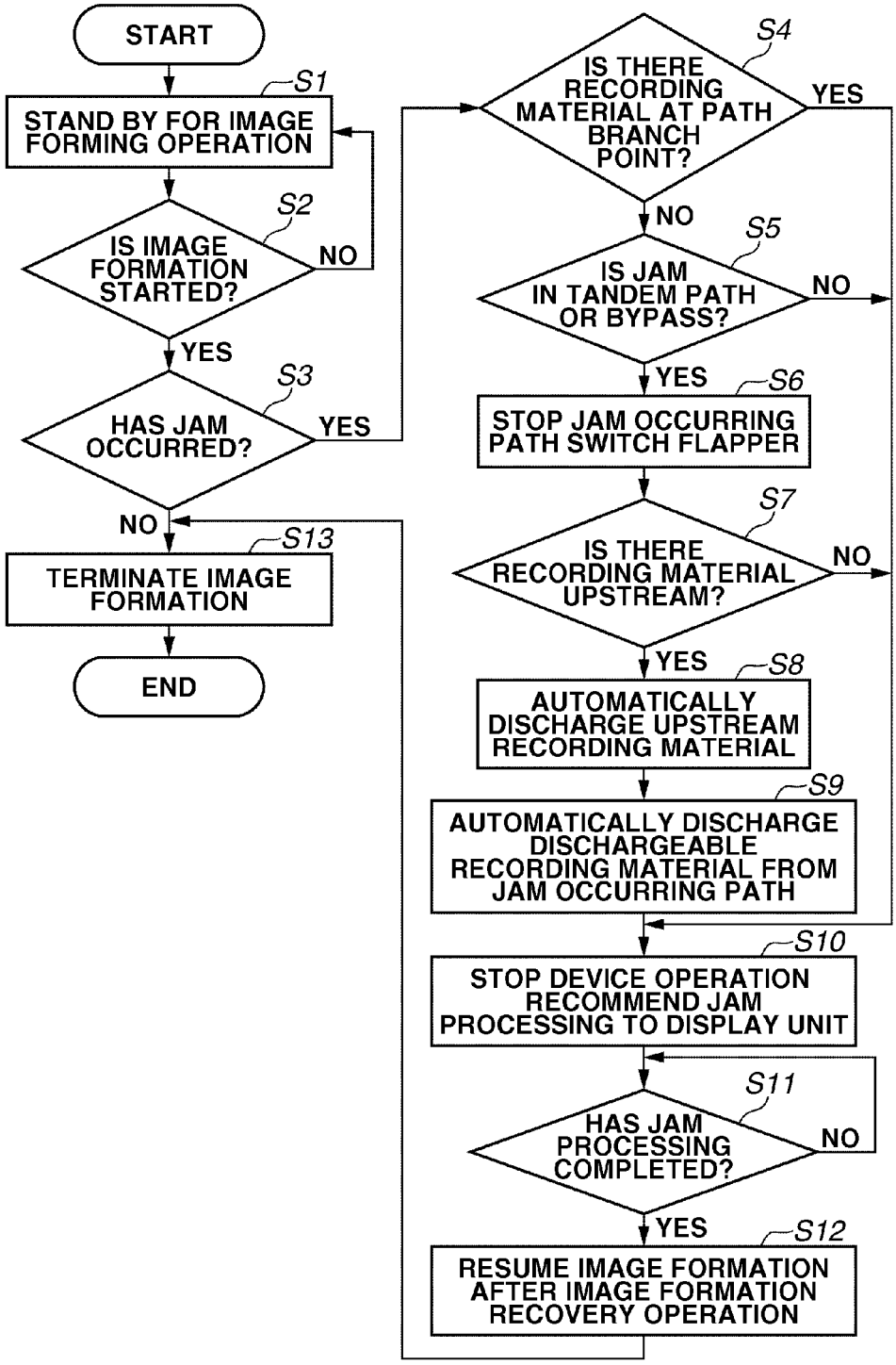
FIG. 5 is a flowchart of a second exemplary embodiment of the present invention.

Referring to a flowchart of FIG. 5, an image forming apparatus according to a second exemplary embodiment of the present invention will be described. Description of items similar to those of the first exemplary embodiment is omitted, and members identical to previously cited members are denoted by identical reference numerals.

In the present exemplary embodiment, when the jam occurs in one of tandem and bypass conveyance paths 71 and 72, after a sheet P left on a side upstream of a branching position 70 is automatically discharged, a dischargeable sheet P left in the conveyance path where the jam has occurred is also automatically discharged.

Figure 4:
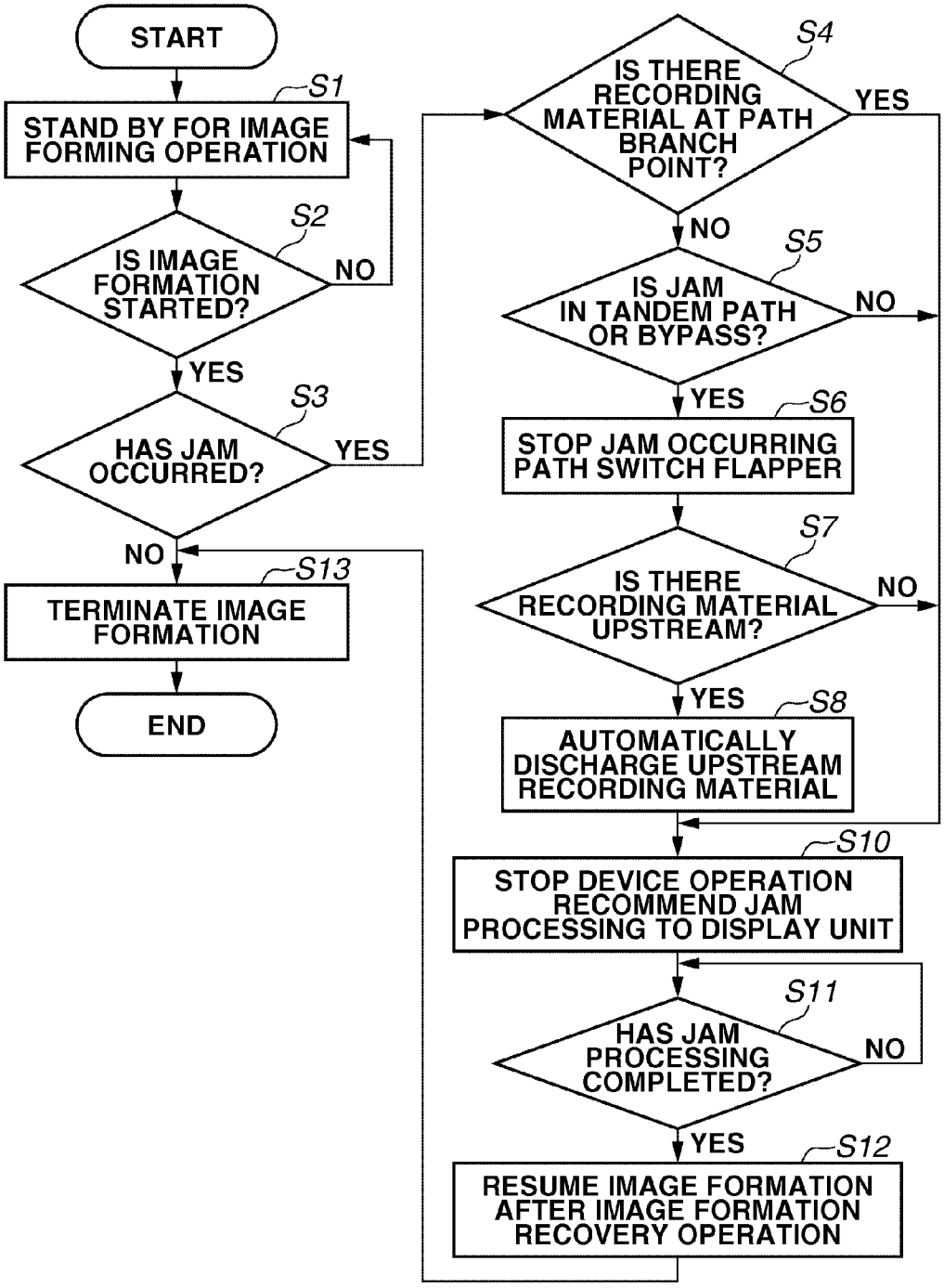
FIG. 4 is a flowchart of the first exemplary embodiment of the present invention.

The image forming apparatus will be described by taking an example where there is a plurality of sheets P left within the tandem conveyance path 71 after the flowchart (step S8) of the first exemplary embodiment illustrated in FIG. 4 is performed, and the sheets P are present on a side upstream of a jam-occurrence position in a sheet conveying direction.

The sheet P left on the side upstream of the jam-occurrence position and on the side downstream of a branching position 70 is first conveyed (moved back) in a reverse direction to be fed to a fixing device 9*a* on the upstream side of the branching position 70. Then, in step S9 of FIG. 5, a flapper 69 is switched to convey the sheet P forward through the bypass conveyance path 72, thereby automatically discharging the sheet P.

The processing will be described by using the example cited in the first exemplary embodiment again. When winding jam occurs in a discharge port of a fixing device 9*b* (delay jam in a position of a sheet detection sensor 74*c*), conveyance in the tandem conveyance path 71 is first stopped to discharge the sheet P on the side upstream of the branching position 70. Then, a main body controller 141 controls a conveying motor 80*c*, a fixing motor 80*a* and the flapper 69 to feed an undamaged sheet P left on a sheet detection sensor 74*b* to the bypass conveyance path 72 in a switch-back manner, thereby enabling automatic discharging.

Thus, regarding the occurrence of jam in the tandem conveyance path 71, for example, when the jam occurs in the fixing device 9*b*, a sheet P can be automatically discharged from the tandem conveyance path 71 in addition to the sheet P left on the upstream side of the branching position. This configuration requires a user only to handle the jam in the fixing device 9*b*, thus jam handling time can greatly shortened.

Figure 6:
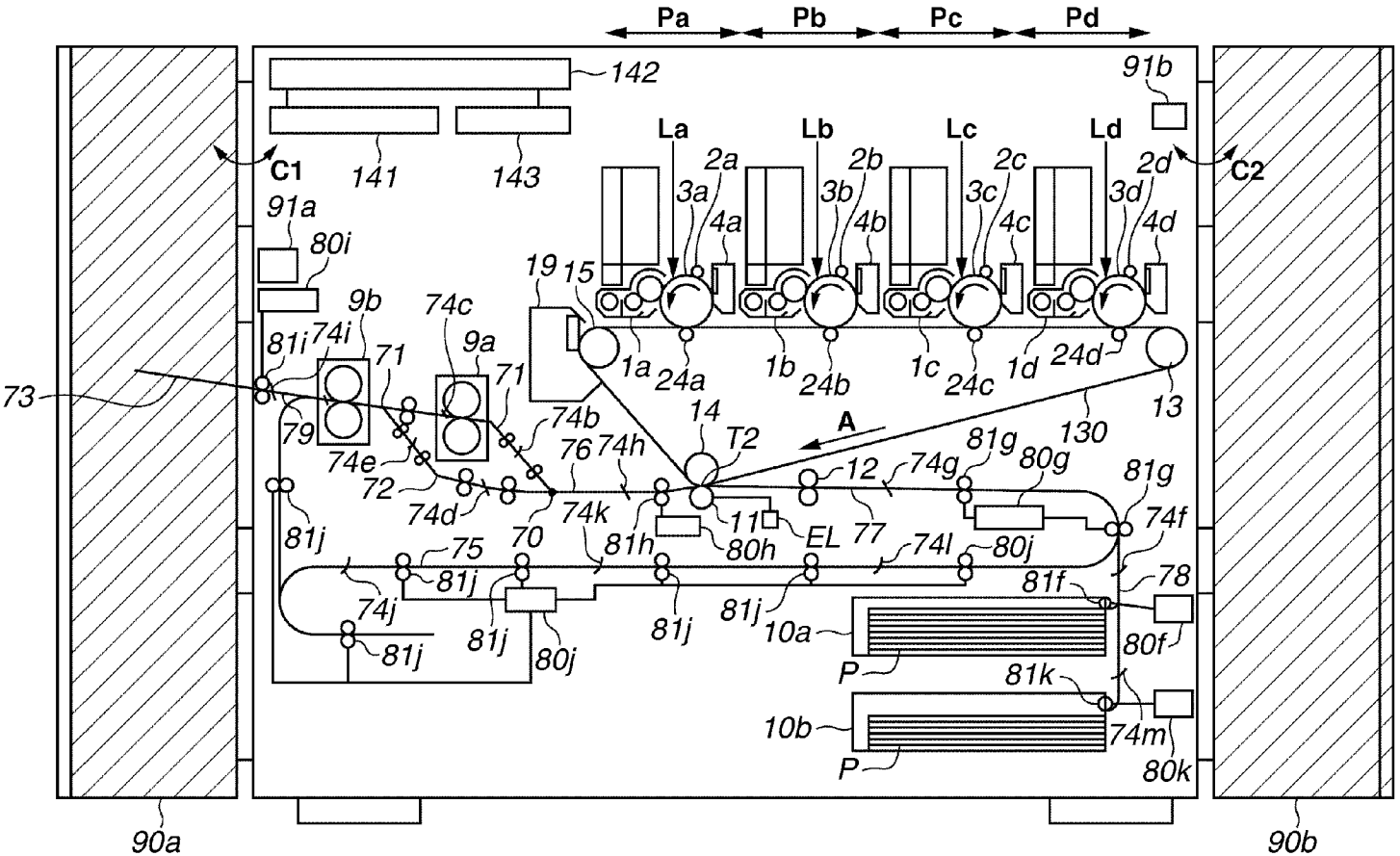
FIG. 6 is a sectional diagram illustrating an image forming apparatus according to a third exemplary embodiment of the present invention.

Referring to FIG. 6, an image forming apparatus according to a third exemplary embodiment of the present invention will be described. Description of items similar to those of the first and second exemplary embodiments is omitted, and members identical to previously cited members are denoted by identical reference numerals.

The third exemplary embodiment is different from the first exemplary embodiment illustrated in FIG. 1 in that the image forming apparatus includes a bypass conveyance path 72 bypassing a first fixing device 9*a*.

With this configuration, as in the case of the first and second exemplary embodiments, using a conveyance path where no jam occurs at the time of an occurrence of jam in one of tandem and bypass conveyance paths 71 and 72, a sheet P left in the apparatus can be automatically discharged.

Recording materials P discharged to a discharge portion 73 by an automatic discharge operation all pass through a second fixing device 9*b*, and hence the inside of the apparatus or user's hands are not stained by an unfixed toner image.

Even in the sectional configuration of the third exemplary embodiment illustrated in FIG. 6, as in the case of the first and second exemplary embodiments, recovery time after jam handling can be shortened, thus usability can be improved.

In each of the first to third exemplary embodiments, the color printer has been cited as the image forming apparatus. However, the image forming apparatus is not limited to the color printer. For example, a copying machine, a facsimile machine or the like may be used as an image forming apparatus. Each of the first to third exemplary embodiments has been described by way of the tandem fixing system where the two fixing devices are arrayed in series on the conveyance path as a plurality of fixing devices. However, the image forming apparatus may include three or more fixing devices.

Each of the first to third exemplary embodiments employs the configuration where the bypass conveyance path bypassing one of the two fixing devices merges onto the tandem conveyance path. However, the configuration is not limited to this type. The present invention can similarly be applied to the following configuration. More specifically, a tandem conveyance path passing through two fixing devices and a single conveyance path passing through only one of the two fixing devices may be provided, and a sheet may be conveyed and discharged through these two conveyance paths to the outside of the image forming apparatus without merging the two conveyance paths together on the downstream side in the sheet conveying direction. In this case, the discharge portion 73 is disposed in each of the tandem and single conveyance paths, and the sheet is directly discharged through the tandem conveyance path or the single conveyance path to the outside of the image forming apparatus.

Figure 8:
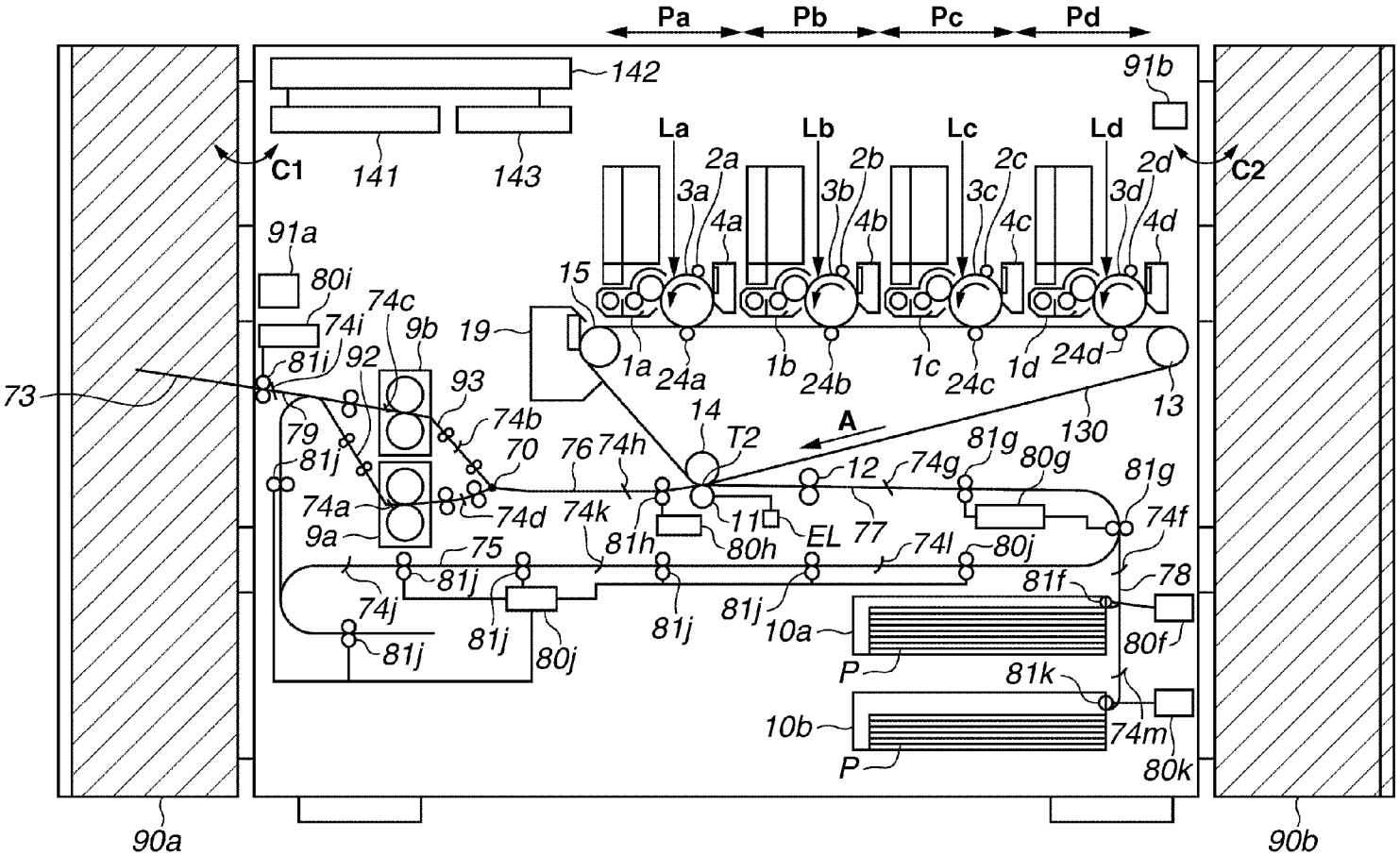
FIG. 8 is a sectional diagram illustrating an image forming apparatus according to another exemplary embodiment of the present invention.

As in the case of an image forming apparatus according to another exemplary embodiment of the present invention illustrated in FIG. 8, the present invention can be applied to an image forming apparatus which includes a conveyance path 92 passing through a first fixing device 9*a* but bypassing a second fixing device 9*b* and a conveyance path 93 passing through the second fixing device 9*b* but bypassing the first fixing device 9*a*.

Thus, by employing the configuration of the exemplary embodiment, the number of jammed sheets handled by a user can be decreased as much as possible, and the time and labor of jam handling imposed on the user can be reduced. As a result, the time necessary for the jam handling by the user can be shortened as much as possible, and a highly usable image forming apparatus can be provided. In other words, an interrupted image forming job can be recovered early.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-289999 filed Nov. 12, 2008, which is hereby incorporated by reference herein in its entirety.

What is claimed is:

1. An image forming apparatus comprising:

an image forming device configured to form a toner image on a sheet;

a first image heating device configured to heat the toner image on the sheet while conveying the sheet at a first nip;

a second image heating device configured to heat the toner image, which is heated by the first image heating device, on the sheet while conveying the sheet at a second nip which is different from the first nip;

a first path for conveyance of the sheet which is heated by the first image heating device toward the second nip;

a second path for conveyance of the sheet which is heated by the first image heating device toward a juncture position merging onto the first path without passing through the second nip;

a first conveying mechanism configured to convey the sheet in the first path;

a second conveying mechanism configured to convey the sheet in the second path;

a first detecting device configured to detect presence or absence of the sheet in the first path;

a second detecting device configured to detect presence or absence of the sheet in the second path; and a controller configured to control an operation of the first conveying mechanism and an operation of the second conveying mechanism, wherein, in response to the controller determining, based on an output of the first detecting device, that jam in the first path occurred, the controller controls the second conveying mechanism so that the sheet in the second path is discharged out of the image forming apparatus through the juncture position, and wherein, in response to the jam, the controller controls a sheet conveying mechanism so that the sheet, which is not jammed, in the first path is reversed at the upstream side with respect to the first nip, and then the reversed sheet is conveyed to the discharge position through the juncture position using the second path, and wherein, in response to the controller determining, based on an output of the second detecting device, that jam in the second path occurred, the controller controls the first conveying mechanism so that the sheet in the first path is discharged out of the image forming apparatus through the juncture position, and wherein, in response to the jam, the controller controls the sheet conveying mechanism so that the sheet, which is not jammed, in the second path is reversed at the upstream side respect to the first nip, and then the reversed sheet is conveyed to the discharge position through the juncture position using the first path.

2. The image forming apparatus according to claim 1, further comprising an informing device, controlled by the controller, to inform that the sheet in the first path is removed by an operator in response to the jam in the first path occurring, and the sheet in the second path is removed by the operator in response to the jam in the second path occurring.

3. The image forming apparatus according to claim 2, wherein the informing device includes a display to inform.

4. An image forming apparatus comprising:

a sheet containing device configured to contain a sheet;

an image forming device configured to form a toner image on a sheet;

a first image heating device configured to heat the toner image on the sheet while conveying the sheet at a first nip;

a second image heating device configured to heat the toner image, which is heated by the first image heating device, on the sheet while conveying the sheet at a second nip which is different from the first nip;

a sheet conveying mechanism, including the first image heating device and the second image heating device, configured to convey the sheet from the sheet containing device to a discharge position out of the image forming apparatus;

a first path for conveyance of the sheet which is heated by the first image heating device toward the second nip;

a second path for conveyance of the sheet which is heated by the first image heating device toward a juncture position merging onto the first path without passing through the second nip;

a first detecting device configured to detect presence or absence of the sheet in the first path;

a second detecting device configured to detect presence or absence of the sheet in the second path; and a controller configured to control an operation of the sheet conveying mechanism, wherein, in response to the controller determining, based on an output of the first detecting device, that jam in the first path occurred, the controller controls the sheet conveying mechanism so that the sheet which is retained at an upstream side with respect to the first nip in a sheet conveying direction of the sheet conveying mechanism is conveyed to the discharge position through the juncture position using the second path without using the first path, and wherein, in response to the jam, the controller controls the sheet conveying mechanism so that the sheet, which is not jammed, in the first path is reversed at the upstream side with respect to the first nip, and then the reversed sheet is conveyed to the discharge position through the juncture position using the second path, and wherein, in response to the controller determining, based on an output of the second detecting device, that jam in the second path occurred, the controller controls the sheet conveying mechanism so that the sheet which is retained at the upstream side with respect to the first nip in a sheet conveying direction of the sheet conveying mechanism is conveyed to the discharge position through the juncture position using the first path without using the second path, and wherein, in response to the jam, the controller controls the sheet conveying mechanism so that the sheet, which is not jammed, in the second path is reversed at the upstream side respect to the first nip, and then the reversed sheet is conveyed to the discharge position through the juncture position using the first path.

5. The image forming apparatus according to claim 4, wherein the controller controls the operation of the sheet conveying mechanism to prevent overlapping of the sheet which is retained at the upstream side with respect to the first nip in the sheet conveying direction, with the sheet which is in the second path when the jam in the first path occurred, and to prevent overlapping of the sheet which is retained at the upstream side with respect to the first nip in the sheet conveying direction, with the sheet which is in the first path when the jam in the second path occurred.

6. The image forming apparatus according to claim 4, further comprising an informing device, controlled by the controller, to inform that the sheet in the first path is removed by an operator in response to the jam in the first path occurring, and the sheet in the second path is removed by the operator in response to the jam in the second path occurring.

7. The image forming apparatus according to claim 6, wherein the informing device includes a display to inform.

8. An image forming apparatus comprising:

an image forming device configured to form a toner image on a sheet;

a first image heating device configured to heat the toner image on the sheet while conveying the sheet at a first nip;

a second image heating device configured to heat the toner image on the sheet while conveying the sheet at a second nip which is different from the first nip;

a first path for conveyance of the sheet which is heated by the first image heating device out of the image forming apparatus;

a second path for conveyance of the sheet which is heated by the first image heating device toward a juncture position merging onto the first path without passing through the second nip;

a first conveying mechanism configured to convey the sheet in the first path;

a second conveying mechanism configured to convey the sheet in the second path;

a first detecting device configured to detect presence or absence of the sheet in the first path at an upstream side with respect to the juncture position in a first conveying direction of the first conveying mechanism;

a second detecting device configured to detect presence or absence of the sheet in the second path at an upstream side with respect to the juncture position in a second conveying direction of the second conveying mechanism; and a controller configured to control an operation of the first conveying mechanism and an operation of the second conveying mechanism, wherein, in response to the controller determining, based on an output of the first detecting device, that jam in the first path at the upstream side with respect to the juncture position occurred, the controller controls the second conveying mechanism so that the sheet in the second path is discharged out of the image forming apparatus through the juncture position, and wherein, in response to the jam, the controller controls a sheet conveying mechanism so that the sheet, which is not jammed, in the first path is reversed at the upstream side with respect to the first nip, and then the reversed sheet is conveyed to the discharge position through the juncture position using the second path, and wherein, in response to the controller determining, based on an output of the second detecting device, that jam in the second path at the upstream side with respect to the juncture position occurred, the controller controls the first conveying mechanism so that the sheet in the first path is discharged out of the image forming apparatus through the juncture position, and wherein, in response to the jam, the controller controls the sheet conveying mechanism so that the sheet, which is not jammed, in the second path is reversed at the upstream side with respect to the first nip, and then the reversed sheet is conveyed to the discharge position through the juncture position using the first path.

* * * * *